United States Patent [19]

Dawson et al.

[11] 4,173,018

[45] Oct. 30, 1979

[54] ANTI-RADAR MEANS AND TECHNIQUES

[75] Inventors: Maynard H. Dawson, San Diego; Leonard P. Suffredini, Santa Ana; John R. O'Neal, San Diego; Converse, William E., Uplands, all of Calif.

[73] Assignee: Whittaker Corporation, Los Angeles, Calif.

[21] Appl. No.: 657,472

[22] Filed: Jul. 27, 1967

[51] Int. Cl.[2] ..... HO1Q

[52] U.S. Cl. ..... 343/18 A

[58] Field of Search ..... 343/18 A

[56] References Cited

U.S. PATENT DOCUMENTS

| | | | |
|---|---|---|---|
| 2,646,549 | 7/1953 | Ragan et al. | 343/18 A |
| 2,877,286 | 3/1959 | Vance et al. | 343/18 A |
| 2,918,671 | 12/1959 | Halpern | 343/18 A |
| 3,187,331 | 6/1965 | Beller | 343/18 A |

*Primary Examiner*—T. H. Tubbesing

*Attorney, Agent, or Firm*—Donald E. Nist

[57] ABSTRACT

Magnetizable particles ranging in size from 0.5 to 20 microns are dispersed in an insulating binder of thermosetting material to form a mixture in which such particles comprise approximately 90% of the weight of such mixture. The particles are either spherical or the mixture may be magnetizable material coated on spherical glass balls of micron size. The mixture is applied by painting or spraying to form a coating of approximately 40 mils or an otherwise metallic reflecting body or may be so applied to a sheet of flexible material which in turn is affixed to a metallic material otherwise exhibiting reflectivity for energy in the frequency range of 2 to 10 Ghz.

8 Claims, No Drawings

ANTI-RADAR MEANS AND TECHNIQUES

The present invention relates generally to anti-radar measures and has as its object to provide a coating for greatly minimizing the amount of energy at radar frequencies otherwise reflected as an echo signal from a reflecting surface.

Such attenuation in general is accomplished using finely divided particles of magnetizable material such as, for example, iron (0.5 to 20 microns in particle diameter) in an insulating binder. A micron is one millionth of an inch. Using this new technique, good practical coatings of practical thickness are readily applied in a simple and expeditious manner for good broad-band effectiveness and particularly so in a high temperature environment for operation within a large range of angles of incidence extending from normal incidence to angles of incidence within 30 degrees (30° ) of grazing incidence.

Such coatings made in accordance with the present invention are particularly useful in preventing, for example, (a) reflection from the trailing edges of aircraft wings, (b) reflection from small protuberances and irregularities, (c) reflection originating from the traveling wave which exists on ogive structures when not illuminated from near-broadside, and (d) reflection from duct entrances which otherwise might involve multiple reflections from the inside of the duct.

Reradiated energy from these common reflection centers enumerated above may be attenuated 12 to 20 decibels over a 2 to 10 GHz (2,000 to 10,000 megacycles per second) by application of an approximate 0.040 inch thick coating produced in accordance with the present invention.

Such coating, unlike ferrite material previously used for attenuation of reflections, remains magnetic at frequencies above 2 GHz, is effective at temperatures at least as high as 500 degrees Centigrade, is relatively inexpensive, and is easily applied.

Small magnetizable particles of micron size are advantageously of iron in that (a) magnetic properties are maintained at frequencies as high as 30 GHz where ferrites are ineffective, (b) the curie temperature of 770 degrees Centigrade is far in excess of ferrite curie temperature, and (c) it has a high saturation magnetic moment, probably higher than that of any known material.

Such iron particles of micron size, each of relatively high electrical conductivity, are maintained electrically insulated from each other by maintaining the same suspended in noncontacting relationship within a matrix of electrical insulating material such that the composite structure (iron particles and matrix) is nonconductive.

The iron particles of micron size may be initially dispersed in a fluid binder, as by a conventional milling operation, to form a homogeneous composite fluid mixture of iron particles and binder, such mixture then being applied in liquid form to surfaces by conventional spraying, rolling or brush application and then allowed to harden on such surfaces as, for example, by a subsequent curing operation.

One example of coating embodying the present invention is formulated as follows using:

| | |
|---|---|
| 6000 grams | iron powder of 5 micron particle size |
| 564 grams | RTV, a General Electric Company silicon composition |
| 128 grams | DC805, a silicon resin of Dow-Corning Company |
| 680 grams | Toluene, a solvent which is later vaporized |
| 7372 grams | |

A fluid mixture so formulated has good shelf life. For best performance, the loading of iron particles was set as high as possible without producing excessive porosity. Such loading is based on a property called the critical pigment volume concentration (PVC) as is well understood in the art of paint formulation. Complete dispersion of the iron powder in the binder is accomplished by ball milling the mixture for 8 hours, or a three-roll paint mill may be used.

Before application to the surface, the mixture is catalyzed by mixing in Thermolite-12 in an amount equal to one percent (1%) by weight of the RTV 11 silicone solids. The addition of Thermolite-12 increases the adhering properties of the mixture. Thermolite-12 is supplied by General Electric Company and is used as a catalyst in the curing operation. The mixture so catalyzed may then be brushed or spray applied to a metal substrate or, if desired, to open weave nylon fabric to form a flexible sheet material which may then be used to cover metal surfaces.

Curing may be accomplished at room temperature with the resulting firm coating of approximately 0.040 inch thickness being iron particles dispersed in nontouching relationship within an insulating binder composed of room temperature cured polymethysiloxane and a polyphenylsiloxane.

Instead of the magnetizable particles being entirely of iron, such particles may be small glass balls coated with a magnetizable material such as iron so as to have an outside diameter of, for example, three microns with the glass ball itself having, for example, a diameter of 0.4 micron. This technique of using glass balls is desirable from the standpoint of lightness and also for assuring the production of a magnetizable particle which is preferably spherical.

It will be appreciated that in application there may be, for example, 8 to 10 sprayings followed by the application of heat from heat lamps as in automobile body painting operations.

Another example of a formulation embodying features of the present invention may involve the use of a sodium silicate binder in which case the binder is essentially metallic as distinct from being organic as in the prior example. By using sodium silicate as a binder, operation at higher temperature is permissible since then the coefficient of heat expansion is more compatible with that of the metal which it coats.

In this latter case, there is a dispersion of iron particles in a sodium silicate binder. The binder consists of 90% by weight of sodium silicate, the other 10% being additives such as silicon dioxide, graphite and potassium titanate, which adjusts the thermal expansion of the material, prevents cracking, and improves internal strength, respectively. The three micron iron particles are added to the binder (90% by weight iron) and are dispersed by ball milling, paddle milling or the like. Such material in liquid form is applied in 1 to 3 mil layers and dried for 10 minutes at 300 degrees Fahrenheit. The final cure of the 40 mil coating is accomplished by baking for one hour each at 300 degrees Fahrenheit, 400 degrees Fahrenheit and 500 degrees Fahrenheit. A top coat of 85% by weight titanium dioxide in sodium silicate is then applied, and the completed coating is heated to 600 degrees Fahrenheit in one hour and maintained at that latter temperature for 30 minutes. A coating thus produced has maintained its radar attenuation capabilities and properties after baking at 800 degrees Fahrenheit for over 200 hours.

While the particular embodiments of the present invention have been shown and described, it will be obvious to those skilled in the art that changes and modifications may be made without departing from the invention in its broader aspects and, therefore, the aim in the appended claims is to cover all such changes and modifications as fall within the true spirit and scope of this invention.

We claim:

1. A mixture used for the attenuation of electromagnetic wave energy in the frequency range of 2 to 10 GHz consisting of magnetizable particles dispersed in an insulating binder, the size of said particles being within the range of 0.5 to 20 microns.

2. A mixture as set forth in claim 1 wherein said magnetizable particles comprise at least one-half the weight of the mixture.

3. A mixture as set forth in claim 1 wherein said magnetizable material comprises approximately 80% of the weight of the mixture.

4. A mixture as set forth in claim 1 wherein said binder is a thermosetting material.

5. A mixture as set forth in claim 1 in which said binder is essentially an organic material.

6. A mixture as set forth in claim 1 in which said particles are essentially spherical.

7. A mixture used for the attenuation of electromagnetic wave energy in the frequency range of 2 to 10 GHz consisting of magnetizable particles dispersed in an insulating binder, said binder being essentially a metallic compound.

8. A mixture used for the attenuation of electromagnetic wave energy in the frequency range of 2 to 10 GHz consisting of magnetizable particles dispersed in an insulating binder, said particles being glass balls coated with a magnetizable material.

* * * * *